US009105424B2

(12) United States Patent
Beck

(10) Patent No.: US 9,105,424 B2
(45) Date of Patent: Aug. 11, 2015

(54) ROCKER SWITCH UNIT

(71) Applicant: Schaffner EMV AG, Luterbach (CH)

(72) Inventor: Fabian Beck, Ruttenen (CH)

(73) Assignee: Schaffner EMV AG, Luterbach (CH)

( * ) Notice: Subject to any disclaimer, the term of this patent is extended or adjusted under 35 U.S.C. 154(b) by 146 days.

(21) Appl. No.: 13/862,086

(22) Filed: Apr. 12, 2013

(65) Prior Publication Data

US 2013/0228424 A1 Sep. 5, 2013

Related U.S. Application Data

(63) Continuation of application No. PCT/EP2010/065304, filed on Oct. 13, 2010.

(51) Int. Cl.

| | |
|---|---|
| ***H01H 61/00*** | (2006.01) |
| ***H01H 23/10*** | (2006.01) |
| *H01H 23/04* | (2006.01) |

(52) U.S. Cl.

CPC ..... *H01H 23/10* (2013.01); *H01H 23/04* (2013.01); *H01H 61/00* (2013.01)

(58) Field of Classification Search

CPC ..... H01H 23/10; H01H 23/04; H01H 61/00; H01H 21/00; H01H 3/00; H01H 13/00; H01H 21/02; H01H 21/025; H01H 21/04; H01H 21/06; H01H 21/12; H01H 23/00; H01H 2203/02; H01H 2207/016; H01H 2207/022; H01H 2227/00; H01R 29/00; H01R 4/66; H01R 13/648; H01R 27/00; H01R 13/68

USPC ..... 200/3, 553, 277.2, 315, 339, 50.07, 200/345, 329, 333, 293, 537

See application file for complete search history.

(56) References Cited

U.S. PATENT DOCUMENTS

| | | | | |
|---|---|---|---|---|
| 3,800,259 | A | 3/1974 | Humphreys | |
| 3,912,895 | A * | 10/1975 | Plana | 200/562 |
| 4,298,854 | A * | 11/1981 | Andersen | 337/10 |
| 6,734,580 | B1 | 5/2004 | Bruchmann | |
| 2008/0006429 | A1 | 1/2008 | Wang | |

FOREIGN PATENT DOCUMENTS

| | | | |
|---|---|---|---|
| DE | 9403879 | U1 | 5/1994 |
| EP | 0690527 | A1 | 1/1996 |
| FR | 2191234 | A1 | 2/1974 |
| FR | 2431762 | A1 | 2/1980 |
| FR | 2499761 | A3 | 8/1982 |
| GB | 1139696 | A | 1/1969 |
| GB | 1170936 | A | 11/1969 |
| GB | 2011722 | A | 7/1979 |
| JP | 58-28931 | | 2/1983 |

(Continued)

*Primary Examiner* — Edwin A. Leon
*Assistant Examiner* — Anthony R. Jiminez
(74) *Attorney, Agent, or Firm* — Blank Rome LLP

(57) ABSTRACT

A removable rocker switch unit (1) has a housing (7) and an ON- and an OFF-position removably fixed to the first end of the housing (2). The rocker switch (3) has two pairs of vertically and horizontally aligned connector elements (4). The housing (7) provides two chambers, each chamber for each phase of the rocker switch (7) including a first and a second connecting elements (5, 8) in each chamber arranged to be connected by a fuse (9), a current limiter (9) or both in a series connection and/or by a varistor (9) between connecting elements (5, 8) of the two different phases.

16 Claims, 3 Drawing Sheets

(56) References Cited

FOREIGN PATENT DOCUMENTS

| | | |
|---|---|---|
| JP | 1-146430 | 10/1989 |
| JP | 1-148619 | 10/1989 |
| JP | 6-15239 | 2/1994 |
| JP | 6-54169 | 7/1994 |
| JP | 2009-289643 | 12/2009 |
| WO | 2010/069392 | 6/2010 |

* cited by examiner

ROCKER SWITCH UNIT

RELATED APPLICATION

This application is a continuation of PCT/EP2010/065304, the content of which are hereby incorporated by reference.

FIELD OF THE INVENTION

The present invention concerns a rocker switch unit that can be used in any apparatus, in a network filter, as IEC entry plug or or any other power entry module.

DESCRIPTION OF RELATED ART

Switches or rocker switches are known prevalent in the prior art. Examples of such embodiments are given.

FR2499761 discloses a bipolar switch provided with a fuse which comprises a modular dimensions body presenting two housings for the bipolar switch and a housing including a fuse holder which can have different dimensions. Two contacts face two terminals used for connection to a neutral feeder line wire. Second feeder wire (phase wire) is connected to the terminal and to the terminal of the fuse holder.

FR2431762 discloses a circuit breaker with selecting prong presenting a cavity used for housing a fuse cartridge. This circuit breaker is intended to be placed on phase conductors of single-phase installations.

EP0690527 discloses a connector for a single phase cable which is used with a power supply network and has a plastic housing with removable covers. The top side of the housing has flat conductors that engage projecting finger contacts, with forked ends that can latch onto conductors. Within base are screw terminals that receive the cables. A fuse is used to link cable ends to the conductors. A removable cover is provided on one side of the housing allowing an easy access to the HRC fuse.

U.S. Pat. No. 3,800,259 discloses a housing which has a pair of spaced first and second contact members for respectively being interconnected in a desired electric circuit whereby the electrical circuit will not be completed unless the contact members are electrically interconnected together. A manually movable fuse member is carried by the housing and has one operating position relative to the housing where the fuse member makes electrical contact between the contact members and through the fuse part thereof so that the circuit will not only be completed by the fuse member, but also the circuit will be fused by the fused member. The fuse member, when moved to another operating position thereof relative to the housing, will break electrical contact between the contact members to open the circuit, whereby the fuse member also acts as a manually operable switch for the electrical circuit.

U.S. Pat. No. 6,734,580 relates to a fused switch unit with a housing and switching rocker, which is mounted in the housing of the fused switch unit such that it can pivot to and fro between a switched-on position and a switched-off position. The fused switch unit has apparatuses for a monitoring circuit and an indication for monitoring the serviceability of a fuse link, with the indication being arranged in the switching rocker. The indication is preferably an optical indication.

FR2191234 discloses a switch with a body, in which a fuse is inserted. The body has to be removed in order to change the body. DE9403879U discloses a similar embodiment.

U.S. Pat. No. 4,298,854 discloses a combined cartridge fuse holder and switch employs a novel switching mechanism including a pair of spaced bars arranged in a first plane and positioned adjacent an inclined ramp. A contact pin is mounted in a switch arm, which in turn is pivotally mounted so that the pin can be moved from an OFF position in which the pin rests on the inclined ramp to an ON position resting on and bridging the contact bars. One of the contact bars is electrically coupled to a first terminal while the other of the contact bars is electrically coupled through a fuse to a second terminal.

GB1170936 and GB1139696 also describe switches including removable fuses.

The disadvantage of these switches is that too many mechanical parts are involved. Too many mechanical parts lead not only to higher production costs per part, but increase the danger of failure of each of these parts. Additionally, especially where the fuse is inside the switch the fuse can not easily be replaced. Another drawback of these switching units comes from the fact that many of them can not be removed as an entire unit, but are connected to the apparatus. In case of failure of the switching unit it is not easy to be removed in order to repair the switch. Another drawback comes from the fact the switches are too big and space consuming.

BRIEF SUMMARY OF THE INVENTION

The present invention aims to produce a rocker switching unit which avoids the drawbacks of the prior art.

Another aim is the production of a switching unit with less mechanical parts than known in the prior art and with a switch body which is simpler than the embodiments known in the prior art.

It is another aim to produce a switching unit which can easily be removed from any apparatus to change the electronic components (fuse, etc.) or the entire unit.

It is another aim to produce a switching unit which less space consuming than the models known from the prior art.

According to the invention, these aims are achieved by means of a rocker switch unit according to the independent claim. Advantageous embodiments are given in the dependent claims.

The advantages of the inventive switching unit comes from the fact that from the housing surrounding the rocker switch such that the rocker switch gives essentially the size of the housing and the entire unit. From the outer side during normal operation the fuses can not be seen. The user does not have to care these fuses. However, the unit can be pulled of from an apparatus easily to change the fuse or even the entire unit, if necessary. This can be described in a manual of the apparatus. The rocker switch unit as discloses herein can be used in any apparatus, in a network filter or as IEC entry plug.

BRIEF DESCRIPTION OF THE DRAWINGS

The invention will be better understood with the aid of the description of an embodiment given by way of example and illustrated by the figures, in which.

DETAILED DESCRIPTION OF POSSIBLE EMBODIMENTS OF THE INVENTION

Figure 1:
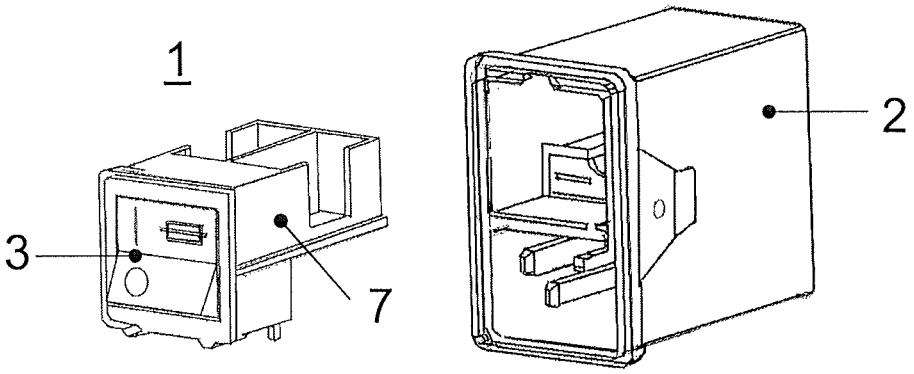
FIG. 1 illustrates a general view from two sides of the rocker switch unit with an IEC inlet filter according to the invention.

FIG. 1 shows a general view of the inventive removable rocker switch unit 1 with a switch body lodging electrical components 9. The rocker switch unit 1, which can be plugged into an EMC IEC inlet filter 2 or any other power entry module. On top of the rocker switch unit 1 is provided a switch or rocker switch having two positions, pivotably switching between one ON-position and one OFF-position. As switch in the present invention it is possible to take a rocker switch 7, an Auto or remote-off rocker switch or simply a current breaker without parting from the inventive idea.

Figure 2:
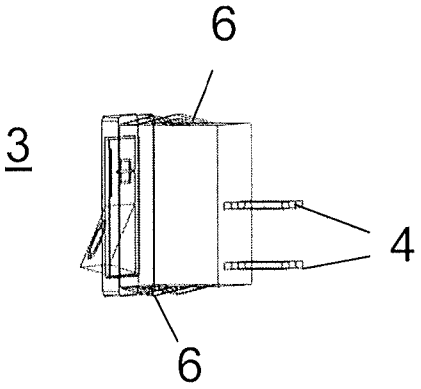
FIG. 2 illustrates a rocker switch.

As seen in the FIG. 2 the switch unit 1 consists out of a rocker switch 3 having on his back side four vertically and horizontally aligned connection elements 4, two of which vertically aligned connection elements 4 can be connected by switching the rocker switch 3 in the ON-position and disconnecting the same by switching the rocker switch in the OFF-position. The number of connection elements 4 is however given by way of example and can be vary according to the rocker switch unit 1. Two clipping element 6 are provided on each side of the rocker switch 3, with which the rocker switch 3 can be fixed to a housing 7. Again, the number of clipping element 6 is given by way of example and can be vary especially according to the size of rocker switch unit 1.

Figure 3:
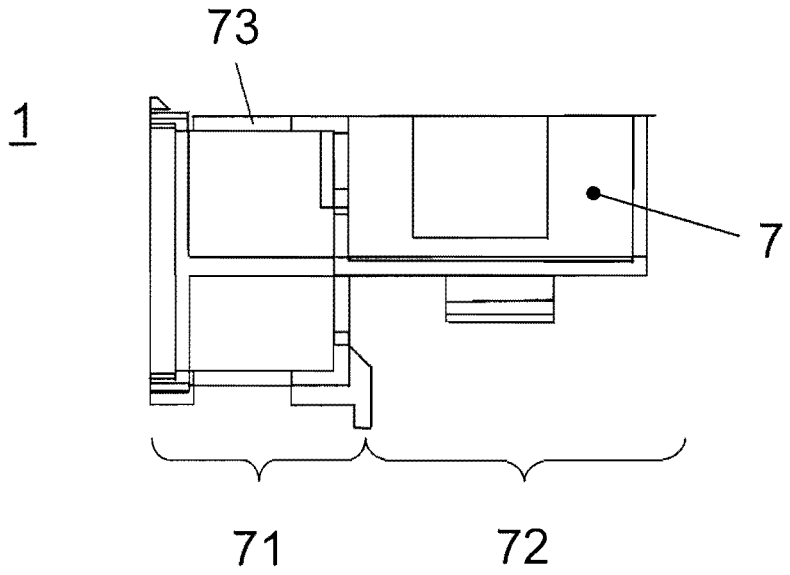
FIG. 3 illustrates a housing of the inventive rocker switch unit.
Figure 6A:
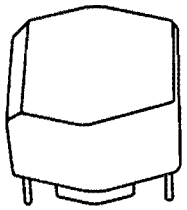
FIG. 6*a, b* illustrates a current limiter and a varistor to be used in the present rocker switch unit.
Figure 6B:
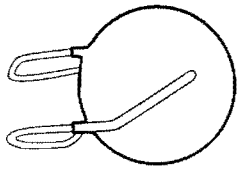

The housing 7 of rocker switch unit 1 is shown in FIG. 3. According to the invention the housing 7 consists of a single moulded piece, although it could possibly consists of different parts. It has a first end 71 to be connected to the rocker switch 3 and a second end 72, in which in an upper part two chambers for a fuse 9, a current limiter 9 and/or a varistor 9 are provided. For security reasons both chambers are separated from each other by an internal wall. According to the invention in the chamber can be enter one of the following elements: a fuse 9, a current limiter 9 (FIG. 6*a*) or said fuse 9 (FIG. 6*b*) and said current limiter 9 in a series connection. In still another possibility a varistor 9 could be connected between connecting elements 5, 8, thereby connecting one phases with the other phase. This varistor 9 could be assembled alone or in addition one or a plurality of said above mentioned elements. If there is only one varistor the connection elements 5, 8 are coupled directly together (e.g. by a wire, directly, by a dummy fuse, etc).

Additionally, the chambers have two lateral apertures for controlling the state of the electrical elements 9 and for better assembling/removing said elements 9. Below the apertures on the outside of the housing 7 lateral guiding rails are provided to guide the unit 1 in the inlet filter 2. Corresponding rails are provided in the inlet filter 2 or the apparatus, where the unit 1 will be entered. Since the chamber has only the size of half of the switcher 3, which is sufficient to house the fuse 9 or the other connection elements, in the bottom part of the second end 72 a step to the first end 71 is created. Apertures 73 in the first end 71 correspond to the clipping element 6 so the first end 71 of the housing 7 can removably fixed around and to the switch 3. In the mentioned step of the housing 7 slits are provided for accommodating the lower connection elements 4 of the switch 3 so to provide external contacts of the entire unit 1. Assembly of the parts of the unit 1 including connecting elements 5, 8, the housing 7 and switch 3 can thus easy be done. The housing 7 has on the front end of the first end protrusions for fastening the unit 1 to any apparatus.

Figure 4A:
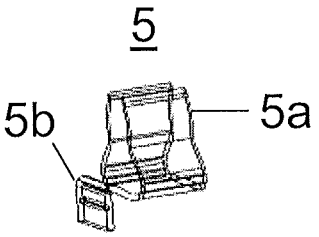
FIG. 4*a, b* illustrate in detail first connection elements.
Figure 4B:
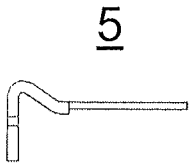

The FIGS. 4*a, b* illustrate in detail first different connection elements 5. For the sake of assembling fuses connecting elements 5 (here fuse holders) are connected to the upper connecting elements 4. The fuse holders 5 consists of a holder 5*a* for clamping the fuses 9 and with slit connecting ends 5*b* shown in detail in FIG. 4*a*. After final assembly, the fuse holders 5 are fixed in a way that the holder 5*a* is within the housing 7 and connecting ends 5*b* are external of the inner wall of the housing 7. In this way not only the fuse holders 5 are directly fixed after assembly, but have also a good contact to the connecting elements 4. To fasten a current limiter 9 and/a varistor 9 FIG. 4*b* illustrates another embodiment of the connecting elements 5. The current limiter and/or the varistor 9 can be fixed to the connecting elements in a known manner such as soldering.

Figure 5A:
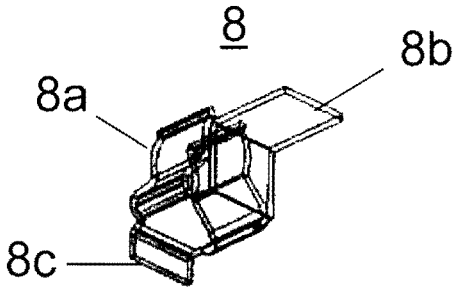
FIG. 5*a, b* illustrate in detail second connection elements.
Figure 5B:
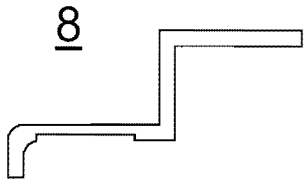

The FIGS. 5*a, b* illustrate in detail second connection elements 8. In the chambers are provided for example second fuse holders 8, which can be seen in detail in FIG. 5*a*. The fuse holder 8 comprise the holder 8*a* itself, the connection elements 8*b*, and ends 8*c*. In place within the chamber, the connection elements 8*b* are provided in slits in the second end of the chambers of the housing 7 to provide external contacts. In the bottom of the house slits are provided to accommodate and fix the ends 8*c* of the fuse holder 8. To fasten a current limiter 9 and/a varistor 9 FIG. 5*b* illustrates another embodiment of the connecting elements 8. The current limiter and/or the varistor 9 can be fixed to the connecting elements in known manner such as soldering.

The housing 7 consists of a single piece in which all part of the unit 1 can easily inserted or removed. The size of the unit 1 corresponds essentially to the size of the switch 3 itself, which representation a great advantage of the unit 1. Due to flexibility of the fuse connectors 5, 8, a fuse 9 can easily be removed or replaced. The assembled unit 1 is shown in FIG. 6.

Figure 7:
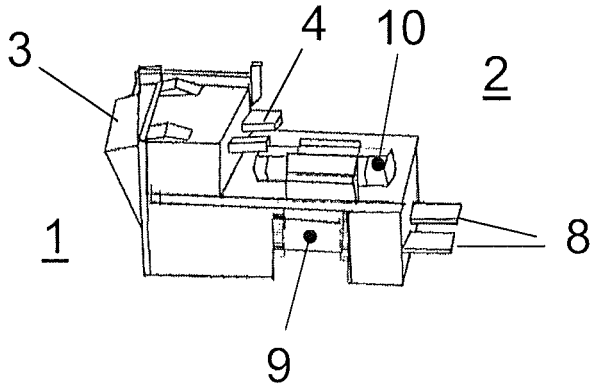
FIG. 7 illustrates a back side view of the inventive rocker switch unit.

FIG. 7 illustrates a back side view of the inventive rocker switch unit 1. As seen in this embodiment a spare fuse 10 can be lodged on the bottom of the second part below the chambers and held by two lateral clipping elements. The entry unit has a recess for accommodating the spare fuse 10 (see FIG. 1).

The advantages of the inventive unit 1 is that from the housing surrounding the rocker switch 3 such that the rocker switch 3 gives essentially the size of the housing and the entire unit 1. From the outer side during normal operation the electrical elements 9 cannot be seen. An user needs not care about these elements 9. However, the unit 1 can be pulled of from an apparatus easily to change the fuse or even the entire unit 1, if necessary. This can be described in a manual of the apparatus. The rocker switch unit 1 as discloses herein can be used in any apparatus, in a network filter, as IEC entry plug or any power entry module.

REFERENCE NUMBERS

1 Rocker switch unit
2 EMC IEC inlet filter
3 Rocker switch
4 Connecting element
5 Connecting element
5*a* Holder
5*b* Slit connection ends
6 Clipping element
7 Housing
71 First end of housing 7
72 Second end of housing 7
73 Aperture in Housing 7
8 Connection element
8*a* Holder
8*b* Connection elements
8*c* End
9 Fuse, varistor and/or current limiter
10 Spare fuse

The invention claimed is:

1. A removable rocker switch unit comprising a housing having a first portion with a first height at a first end and a second portion with a second height at a second end, wherein the second height is smaller than the first height;

a rocker switch having an ON- and an OFF-position removably fixed to the first end of the housing in the first portion, said rocker switch having a first connector element, a second connector element, a third connector element and a fourth connector element, wherein the first connector element and the second connector element are connected by switching the rocker switch to the ON-position for connecting a first phase of the rocker switch unit and the third connector element and the fourth connector element are connected by switching the rocker switch to the ON-position for connecting a second phase of the rocker switch unit;

said second portion of said housing providing a first chamber and a second chamber, the first chamber for the first phase of said rocker switch comprising a first connection element connected to the first connector element of said rocker switch, when the rocker switch is fixed to the first end of the housing, and a second connection element for the connection of an external element, the second chamber for the second phase of said rocker switch comprising a third connection element connected to the third connector element of said rocker switch, when the rocker switch is fixed to the first end of the housing, and a fourth connection element for the connection of the external element;

said first connection element and said second connection elements in the first chamber connected by a fuse, a current limiter or both in a series connection;

said third connection element and said fourth connection element in the second chamber connected by a fuse, a current limiter or both in a series connection:, said first portion of said housing in the direction of the second end of the housing below said second portion being closed by a wall, said wall providing slits for said second connector elements and said fourth connector element protruding from the rocker switch unit for connecting the rocker switch unit with the external unit, when the rocker switch is fixed to the first end of the housing.

2. The removable rocker switch unit of claim 1, wherein said rocker switch is a rocker switch, an auto or remote-off rocker switch or a current breaker.

3. The removable rocker switch unit of claim 1, wherein a spare fuse is removably fixed on the bottom of the second portion below said first and second chambers.

4. The removable rocker switch unit of claim 1, wherein the fuse in the first chamber is held by a first fuse holder as first connection element and by a second fuse holder as second connection element and/or the fuse in the second chamber is held by a third fuse holder as third connection element and by a fourth fuse holder as fourth connection element.

5. The removable rocker switch unit of claim 4, wherein said second fuse holder comprises a holder, a connecting element and an end, said connecting element protruding through a slit of an end of the first chamber opposite to the rocker switch for connecting the rocker switch unit with said external element, said end being fixed to the bottom of said first chamber and/or said fourth fuse holder comprises a holder, a connecting element and an end , said connecting element protruding through a slit of an end of the second chamber opposite to the rocker switch for connecting the rocker switch unit with said external element, said end being fixed to the bottom of said second chamber.

6. The removable rocker switch unit of claim 1, wherein said rocker switch has clipping elements for removably fixing said switch to said housing and wherein corresponding apertures are provided in said in housing.

7. The removable rocker switch unit of claim 1, wherein said first chamber and second chamber have lateral apertures.

8. The removable rocker switch unit of claim 1, wherein on the outside of the housing lateral guiding rails are provided.

9. The removable rocker switch unit of claim 1, wherein the housing has on the front end of the first portion protrusions for fastening the unit to an apparatus.

10. The removable rocker switch unit of claim 1, wherein the housing comprises a single piece.

11. The removable rocker switch unit of claim 1, wherein the housing surrounds the rocker switch such that the rocker switch is substantially the size of the housing.

12. A use of the removable rocker switch unit of claim 1, whereby the removable rocker switch unit is removably inserted into an apparatus, in a network filter or as IEC entry plug.

13. An apparatus, network filter or IEC entry plug comprising an aperture for removably inserting the removable rocker switch unit of claim 1.

14. The removable rocker switch of claim 1, wherein said first phase provided by the first connection element, the second connection element, the first connector element and the second connector element are connected by a varistor with said second phase provided by the third connection element, the fourth connection element, the third connector element and the fourth connector element.

15. A removable rocker switch unit comprising a housing having a first portion with a first height at a first end and a second portion with a second height at a second end, wherein the second height is smaller than the first height;

a rocker switch having an ON- and an OFF-position removably fixed to the first end of the housing in the first portion, said rocker switch having a first connector element, a second connector element, a third connector element and a fourth connector element, wherein the first connector element and the second connector element are connected by switching the rocker switch to the ON-position for connecting a first phase of the rocker switch unit and the third connector clement and the fourth connector element are connected by switching the rocker switch to the ON-position for connecting a second phase of the rocker switch unit;

said second portion of said housing providing a first chamber and a second chamber, the first chamber for the first phase of said rocker switch comprising a first connection element connected to the first connector element of said rocker switch, when the rocker switch is fixed to the first end of the housing, and a second connection element for the connection of an external element, the second chamber for the second phase of said rocker switch comprising a third connection element connected to the third connector element of said rocker switch, when the rocker switch is fixed to the first end of the housing, and a fourth connection element for the connection of the external element;

said first connection clement and said second connection element in the first chamber are connected by a fuse, a current limiter, or both in a series connection or by a direct coupling;

said third connection element and said fourth connection element in the second chamber connected by a fuse, a current limiter or both in a series connection or by a direct coupling;

said first phase provided by the first connection element, the second connection element, the first connector element and the second connector element is connected by a varistor with said second phase provided by the third connection element, the fourth connection element, the third connector element and the fourth connector element;

said first portion of said housing in the direction of the second end of the housing below said second portion being closed by a wall, said wall providing slits for said second connector element and said knoll connector element protruding from the rocker switch unit for connecting the rocker switch unit with the external unit, when the rocker switch is fixed to the first end of the housing.

16. A removable rocker switch unit comprising a housing having a first portion with a first height at a first end and a second portion with a second height at a second end, wherein the second height is smaller than the first height;

a rocker switch having an ON- and an OFF-position removably fixed to the first end of the housing in the first portion, said rocker switch having a first connector element, a second connector element, a third connector element and a fourth connector element, wherein the first connector element and the second connector element are connected by switching the rocker switch to the ON-position for connecting a first phase of the rocker switch unit and the third connector element and the fourth connector element are connected by switching the rocker switch to the ON-position for connecting a second phase of the rocker switch unit;

said second portion of said housing providing a first chamber and a second chamber, the first chamber for the first phase of said rocker switch comprising a first connection element connected to the first connector element of said rocker switch, when the rocker switch is fixed to the first end of the housing, and a second connection element for the connection of an external element, the second chamber for the second phase of said rocker switch comprising a third connection element connected to the third connector element of said rocker switch, when the rocker switch is fixed to the first end of the housing, and a fourth connection element for the connection of the external element:

said first connection element and said second connection element in the first chamber connected by a fuse, a current limiter or both in a series connection;

said third connection element and said fourth connection element in the second chamber connected by a current limiter;

said first portion of said housing in the direction of the second end of the housing below said second portion being closed by a wall, said wall providing slits for said second connector element and said fourth connector element protruding from the rocker switch unit for connecting the rocker switch unit with the external unit, when the rocker switch is fixed to the first end of the housing.

* * * * *